US008210869B2

(12) United States Patent
Nakatsuka

(10) Patent No.: US 8,210,869 B2
(45) Date of Patent: Jul. 3, 2012

(54) BOOSTER CABLE

(75) Inventor: Yoshiaki Nakatsuka, Naka (JP)

(73) Assignee: Seiwa Industry Co., Ltd, Osaka (JP)

( * ) Notice: Subject to any disclaimer, the term of this patent is extended or adjusted under 35 U.S.C. 154(b) by 0 days.

(21) Appl. No.: 12/504,811

(22) Filed: Jul. 17, 2009

(65) Prior Publication Data

US 2011/0014813 A1 Jan. 20, 2011

(51) Int. Cl.
*H01R 11/00* (2006.01)

(52) U.S. Cl. ..... 439/504

(58) Field of Classification Search ..... 439/504, 439/835, 755, 577, 822, 241, 217
See application file for complete search history.

(56) References Cited

U.S. PATENT DOCUMENTS 3,745,516 A * 7/1973 Lieberman ..... 439/755
7,422,474 B1 * 9/2008 Good ..... 439/504
7,785,116 B2 * 8/2010 Akahori et al. ..... 439/76.2
2002/0031956 A1 * 3/2002 Nakatsuka ..... 439/835
2006/0223384 A1 * 10/2006 Schuh ..... 439/759

FOREIGN PATENT DOCUMENTS

JP 5-45931 U 6/1993

* cited by examiner

*Primary Examiner* — Edwin A. Leon
(74) *Attorney, Agent, or Firm* — Birch, Stewart, Kolasch & Birch, LLP

(57) ABSTRACT

The present invention provides a booster cable capable of reliably being connected to a terminal that is provided in a limited space. Specifically, a connecting clip 3 is attached to both ends of a cable main body 4. Clamping sections 6*a* of the connecting clip 3 are set to be wide and outer surfaces of the pair of clamping sections 6*a* are set to be substantially in parallel in a closed state so that the clamping sections 6*a* are set to have approximately same thickness up to root portions. The root portions of the clamping sections 6*a* do not interfere so that the clamping sections 6*a* are able to be inserted into a limited space up to the root portions. It is thereby possible to sufficiently clamp and reliably connect the assisting terminal 5 that is provided in a limited space.

2 Claims, 10 Drawing Sheets

BOOSTER CABLE

BACKGROUND OF THE INVENTION

1. Field of the Invention

The present invention relates to a booster cable for connecting batteries, for instance, to supply electricity from one of the batteries to the other battery.

2. Description of the Related Art

Generally, when a battery mounted on a vehicle is completely discharged, electricity is supplied by connecting a battery of an assisting car to the discharged battery. For connecting the battery of the assisting car to the discharged battery, a booster cable is used.

The booster cable has a structure in which connecting clips to be connected to electrode terminals are attached to both ends of a cable main body. The connecting clip has a structure in which a pair of metal members are pivotally joined with each other so that clamping sections on the tip end portion open and close to clamp the electrode terminal. The clamping sections of the connecting clip are formed into a tapered shape having a thick root portion and great strength and rigidity so as to clamp, for example, the cylindrical electrode terminal strongly.

For example, a hybrid car is provided with an auxiliary battery of low voltage, as well as a hybrid battery of high voltage for supplying high voltage power to a drive motor, for the purpose of supplying electricity to appliances (auxiliaries) other than the drive motor. The auxiliary battery is used for supplying electricity to a computer which controls the drive motor, and is used as power source of a car air conditioner or the like. In the case of supplying electricity to the auxiliary battery of a hybrid car, a battery of an assisting car is connected to an assisting terminal inside a fuse box equipped in an engine room. However, since a space inside the fuse box is limited, the clamping sections of the connecting clip are difficult to be inserted therein and incapable of clamping the assisting terminal sufficiently.

It is therefore an object of the present invention to provide a booster cable capable of being connected to a terminal provided in a limited space reliably.

SUMMARY OF THE INVENTION

In order to accomplish the aforementioned object, the present invention provides a booster cable in which a connecting clip is attached to both ends of a cable main body, in which the connecting clip is covered by an insulating cover, and so that a pair of clamping sections, exposed from the insulating cover, are inserted into a limited space to be capable of clamping a flat terminal connected to a battery side from the tip end part of the terminal, it is set such that the clamping sections are wide and outer surfaces of the pair of clamping sections are substantially parallel in a closed state of the clamping sections.

According to the structure above, since the clamping sections are formed to be wide, it is possible to increase strength and rigidity of the clamping sections without forming root portions of the clamping sections to be thick. Further, by setting the outer surfaces of the pair of clamping sections to be substantially parallel in the closed state, it is possible that the clamping sections are set to have approximately same thickness up to the root portions thereof. Thus, when inserting the clamping sections into a limited space, it is possible to prevent the root portions from interfering with the insertion such as the case of tapered clamping sections.

Additionally, as the clamping sections are formed to be wide, it is possible to clamp the flat terminal from the tip end part stably. This makes it possible to set the terminal to be flat to reduce the opening amount of the clamping sections required to clamp the terminal. As a result, even when the space where the terminal is provided is limited, it is possible that the clamping sections are inserted into the space to clamp the terminal and to reliably connect the connecting clip to the terminal.

Furthermore, according to the present embodiment, there is provided a booster cable in which a connecting clip is attached to both ends of a cable main body, in which the connecting clip is covered by an insulating cover, and so that a pair of clamping sections, exposed from the insulating cover, are inserted into a fuse box equipped in an engine room of an automobile to be capable of clamping a flat assisting terminal, protrudingly provided inside the fuse box and electrically connected to an auxiliary battery, from the tip end part of the assisting terminal, it is set that the clamping sections are wide and outer surfaces of the pair of clamping sections are substantially parallel in a closed state of the clamping sections. This structure is the same as that of the above described booster cable, and the clamping sections are capable of stably clamping the flat assisting terminal, protrudingly provided in a limited space of the fuse box, from the tip end part thereof. This makes it possible to reliably connect the booster cable to the assisting terminal, protrudingly provided inside the fuse box of the engine room and electrically connected to the auxiliary battery.

The connecting clip can have a structure provided with a pair of metal members having a clamping section on the tip end part and a gripping section on the base end part, a pivoting shaft that pivotally joins center sections of the pair of metal members with each other, and a spring that drives the pair of clamping sections in the closing direction. According to the structure, it is possible to employ the above described structure for the clamping section as well as to employ the same structure as that of a conventional connecting clip for other parts.

As is clear from the above description, according to the present invention, it is set such that clamping sections are wide and outer surfaces of the pair of clamping sections are substantially parallel in a closed state. Thereby, it is possible that the clamping sections are inserted into a limited space sufficiently so as to stably clamp a flat terminal provided in the space. As a result, for example, a booster cable is capable of being connected to an assisting terminal in a fuse box of an engine room of an automobile reliably.

DETAILED DESCRIPTION OF THE PREFERRED EMBODIMENTS

Below, an embodiment of a booster cable according to the present invention will be described with reference to the accompanying drawings.

Figure 1:
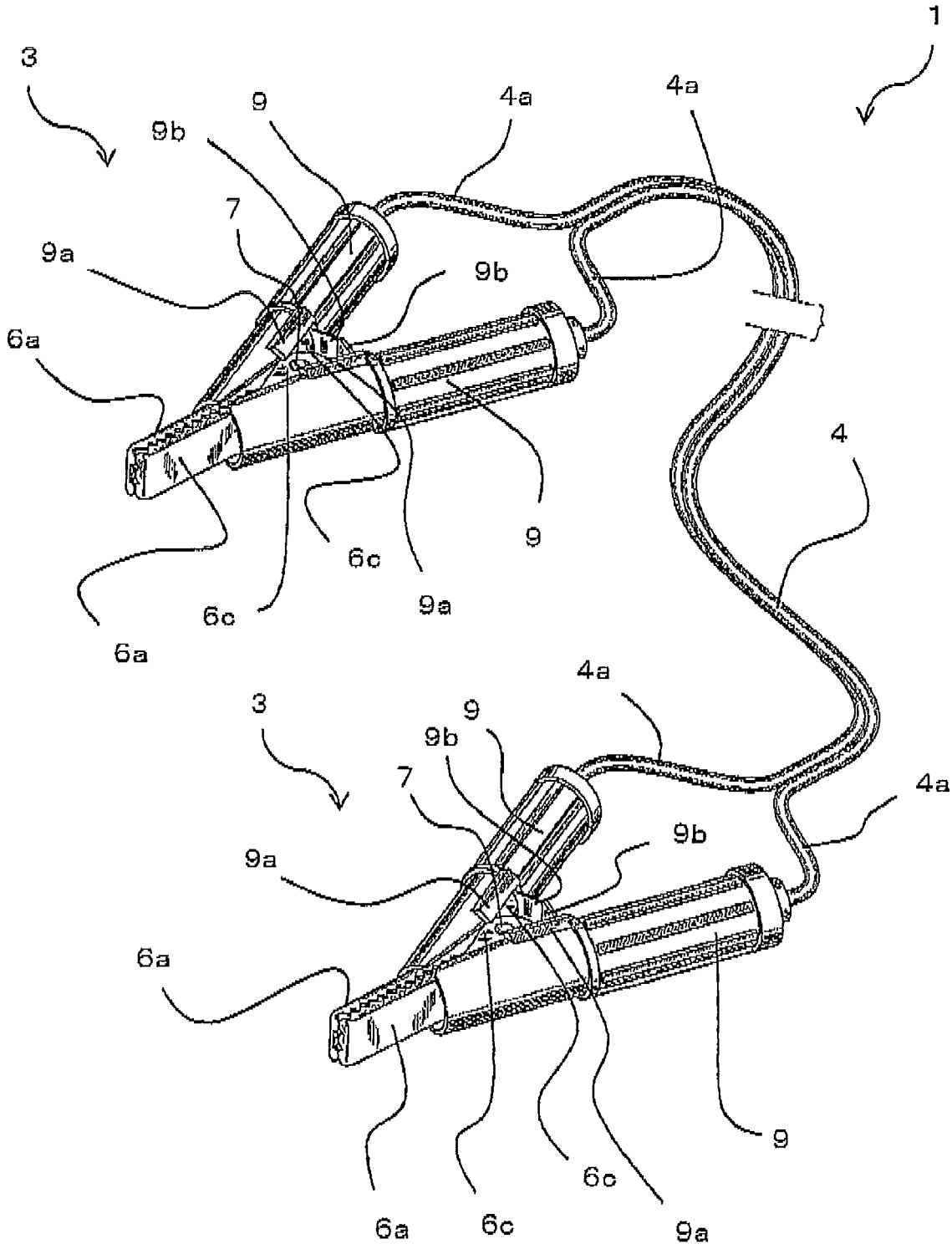
FIG. 1 is a perspective view of a booster cable.
Figure 2:
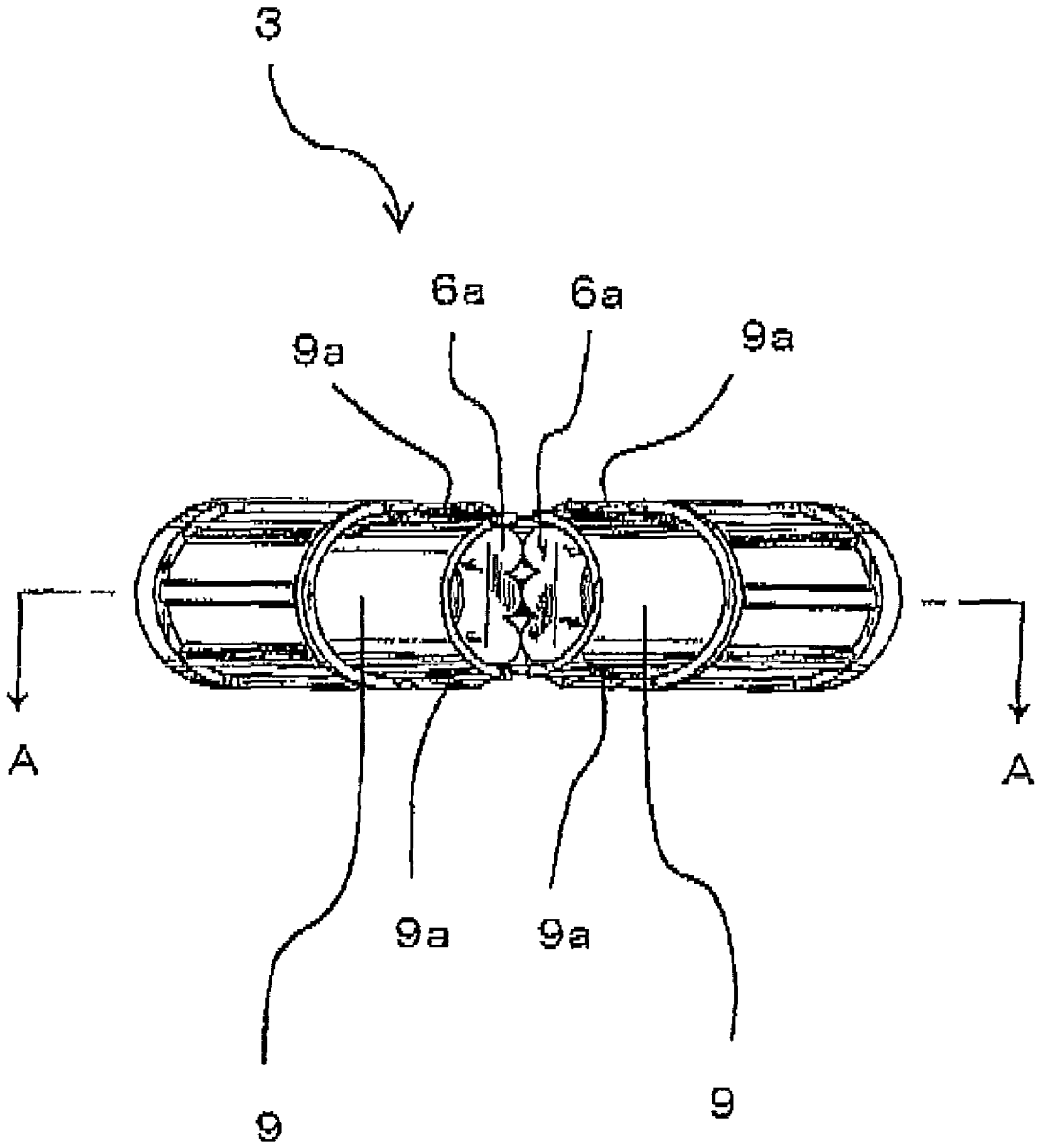
FIG. 2 is a front view of a connecting clip of the booster cable according to the present invention.
Figure 3:
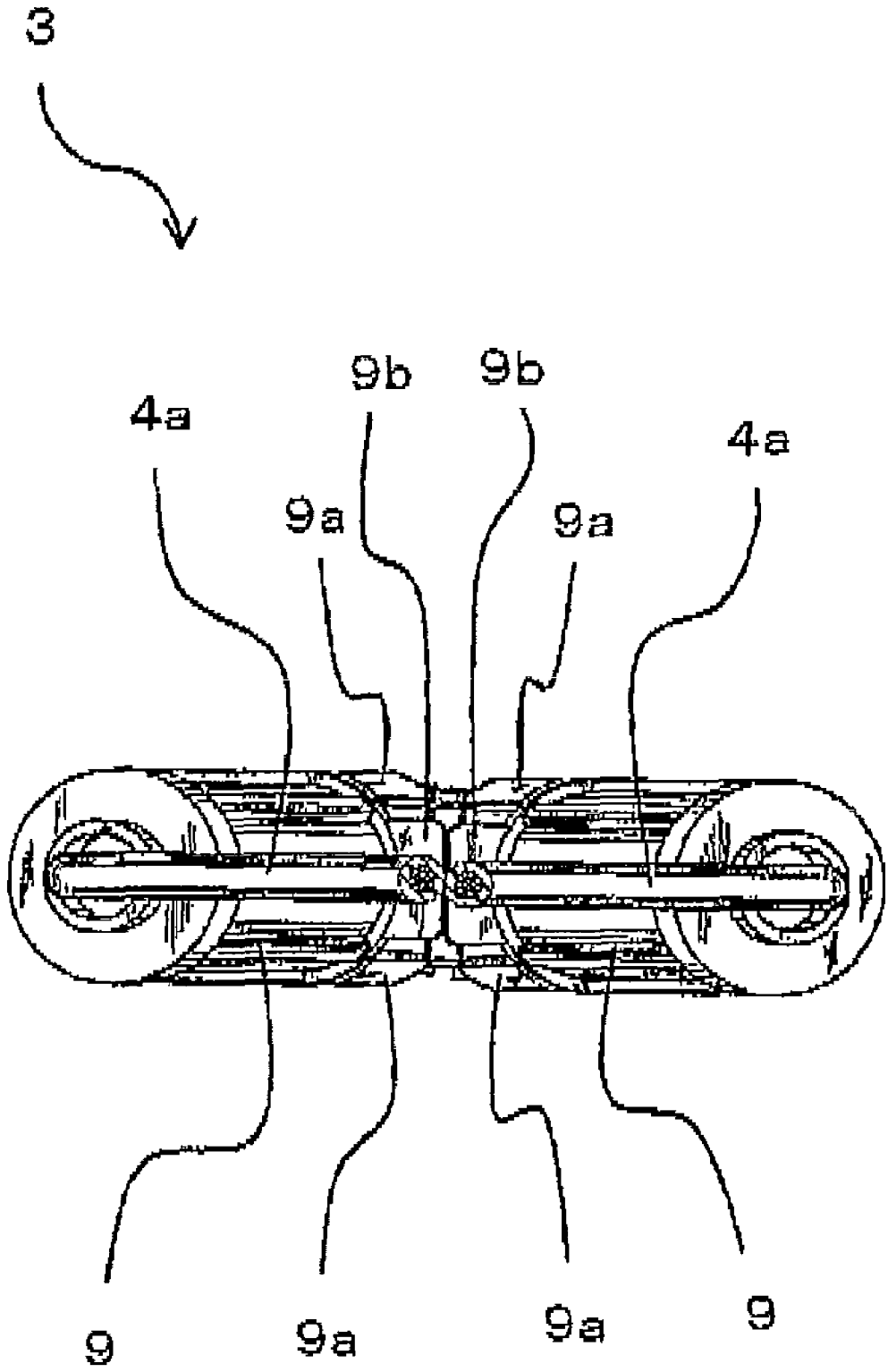
FIG. 3 is a rear view of the connecting clip.
Figure 4:
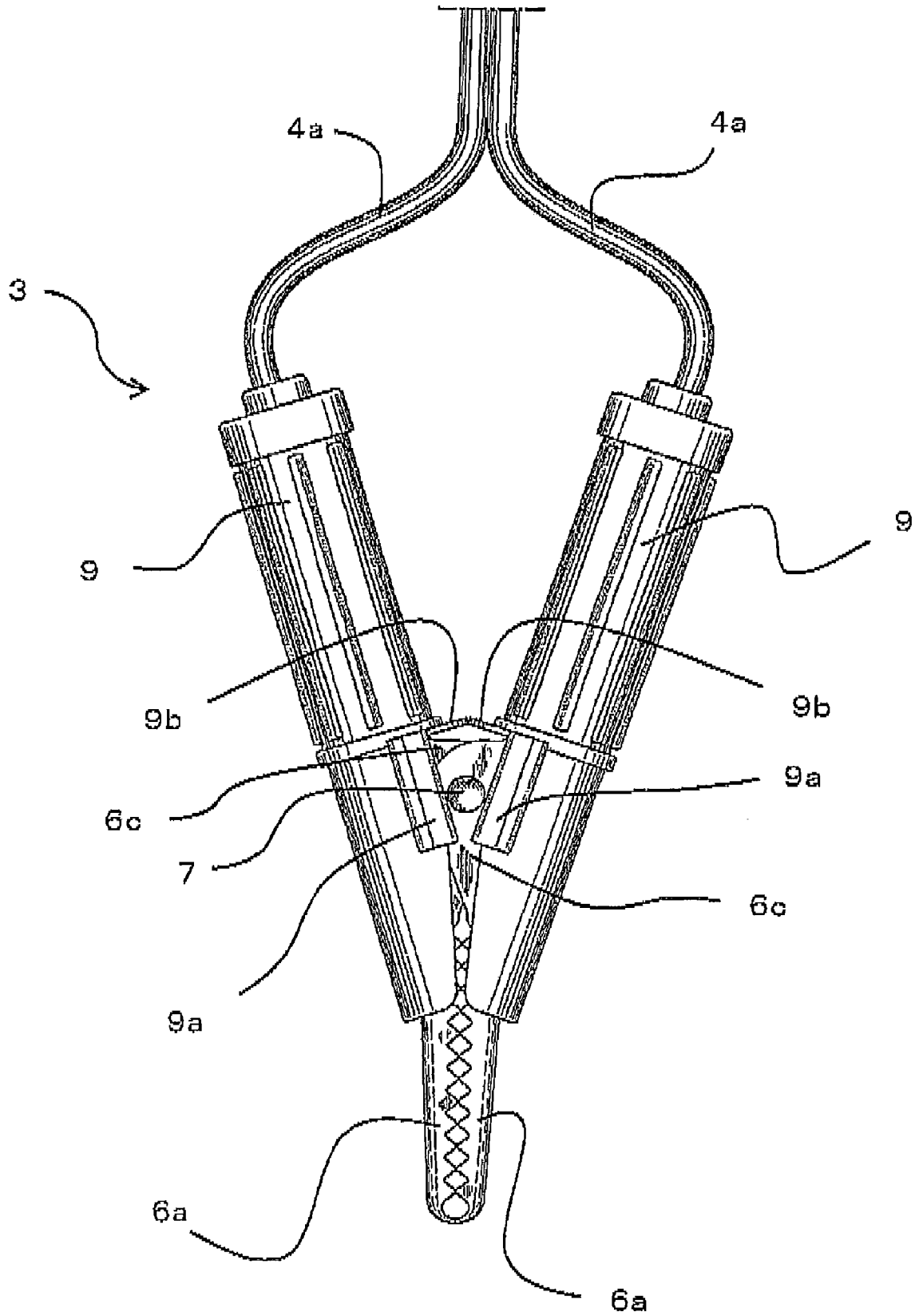
FIG. 4 is a plan view of the connecting clip.
Figure 5:
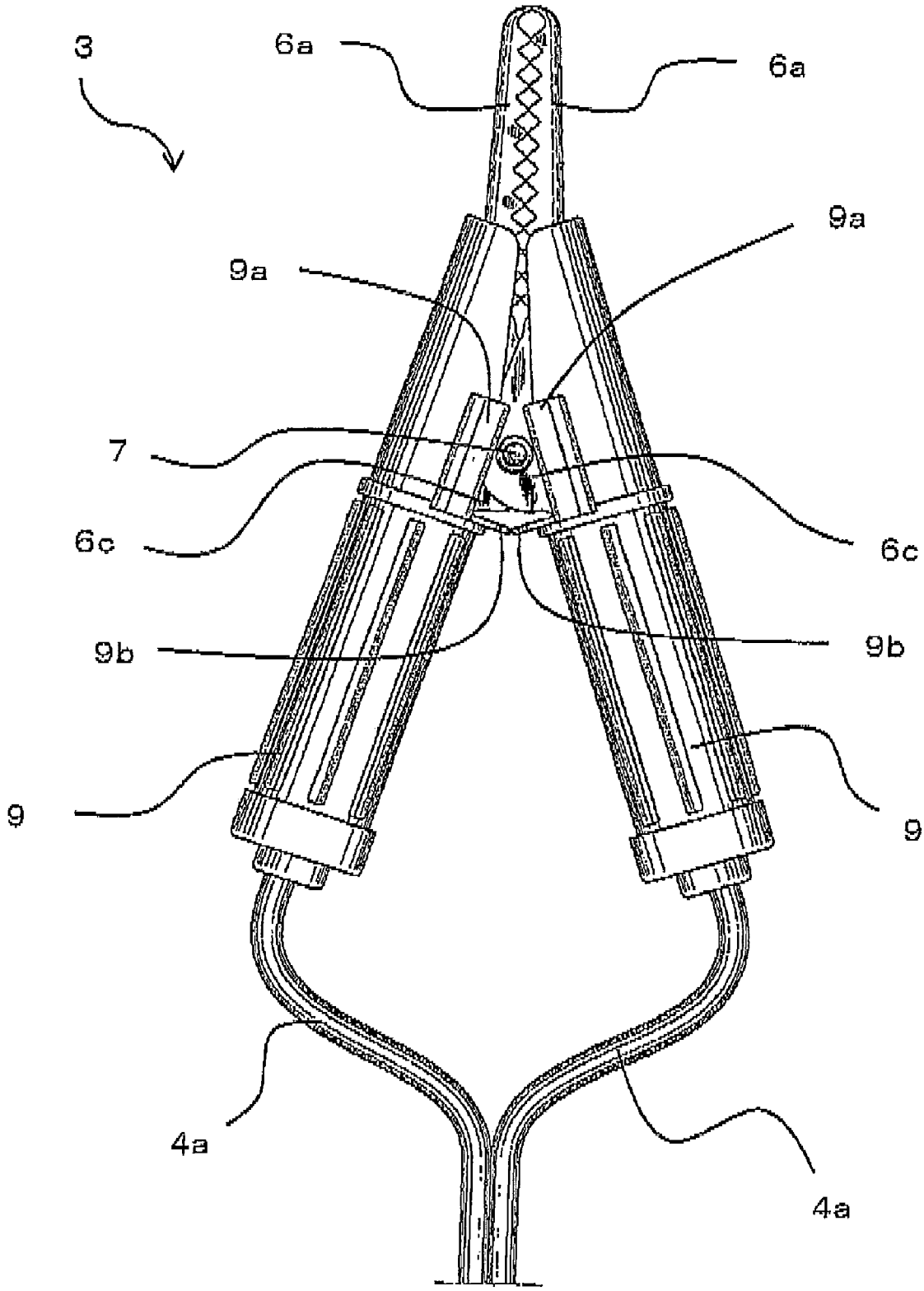
FIG. 5 is a bottom view of the connecting clip.
Figure 6:
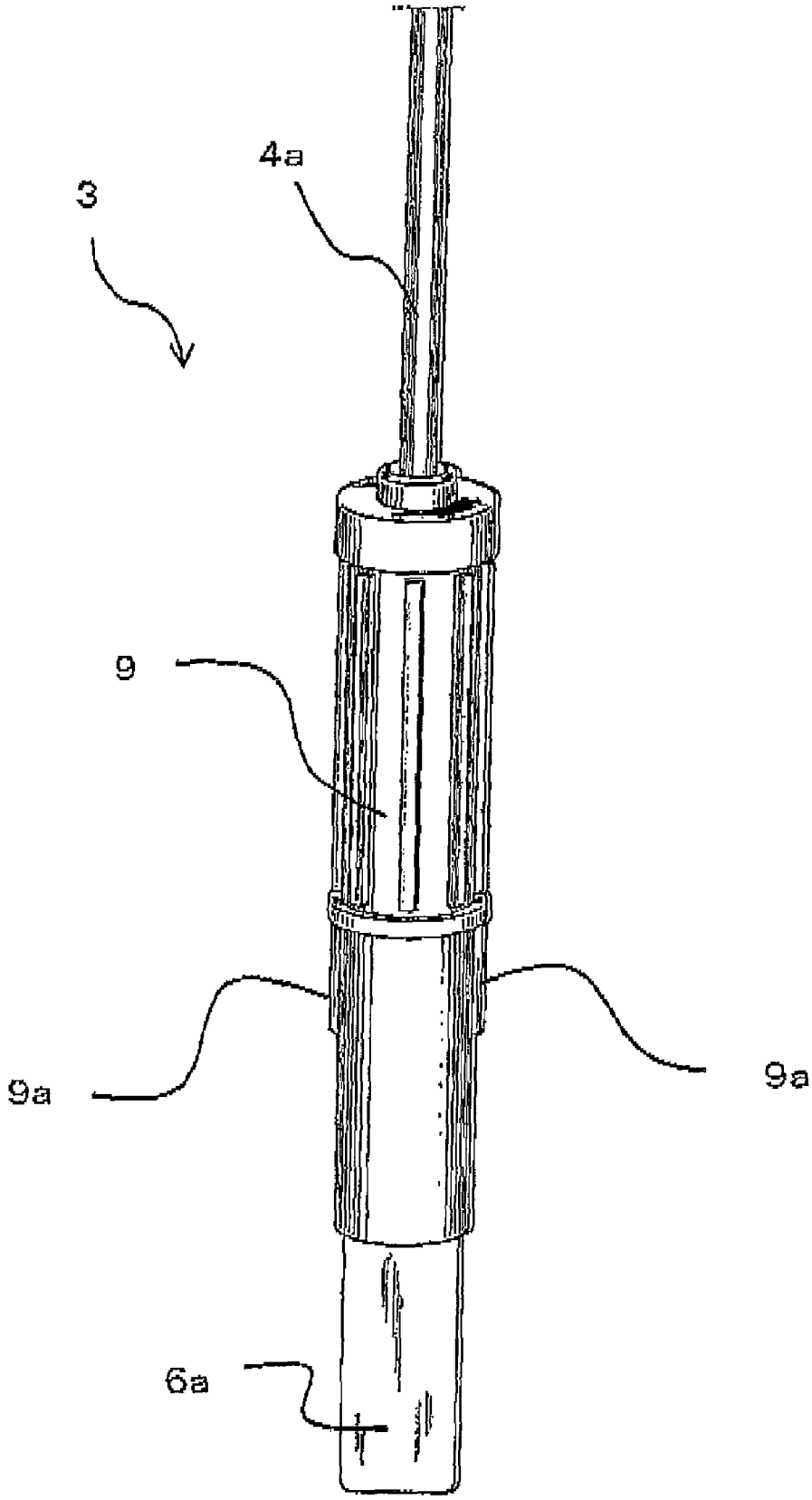
FIG. 6 is a left side view of the connecting clip.
Figure 7:
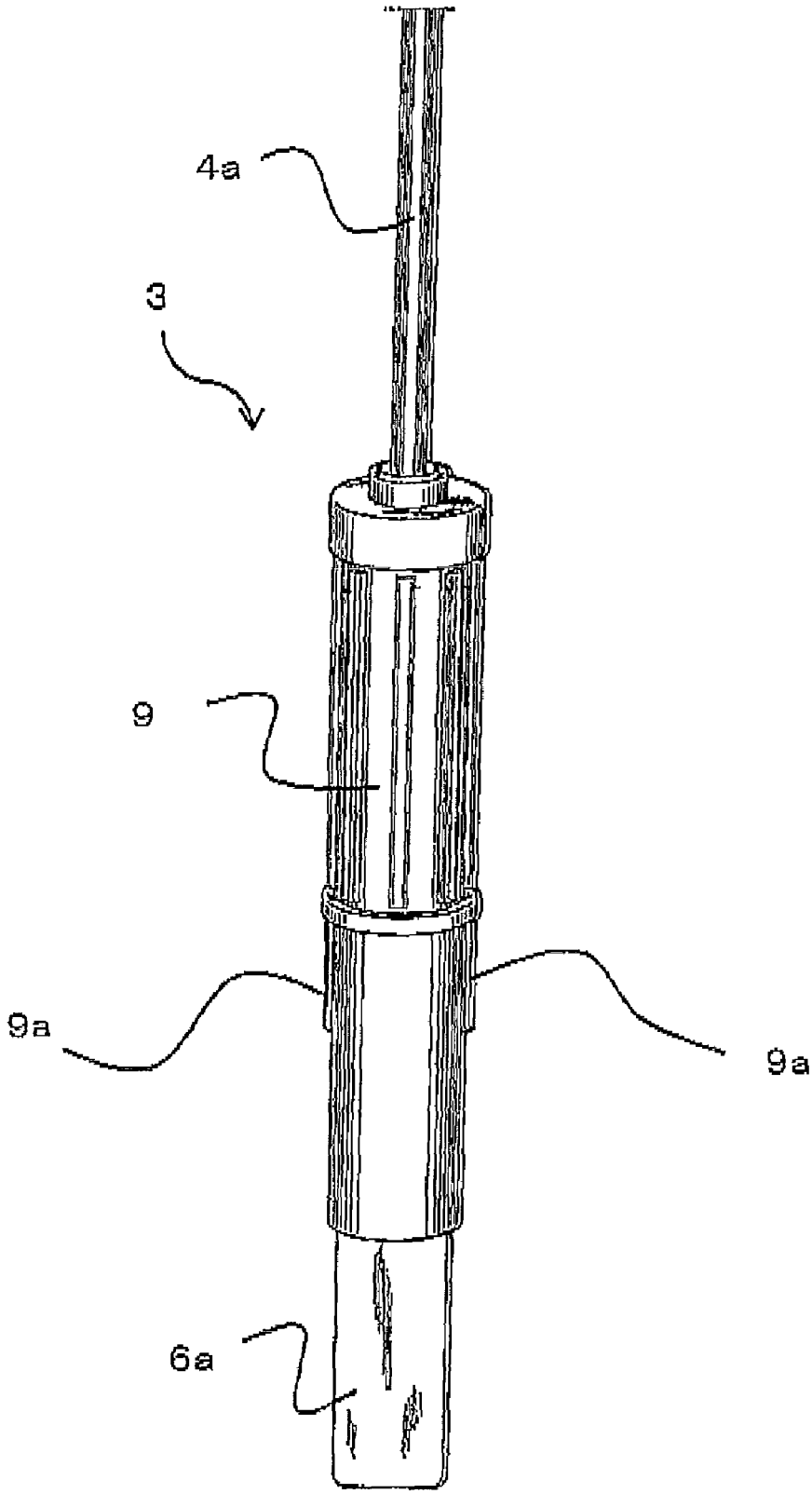
FIG. 7 is a right side view of the connecting clip.
Figure 8:
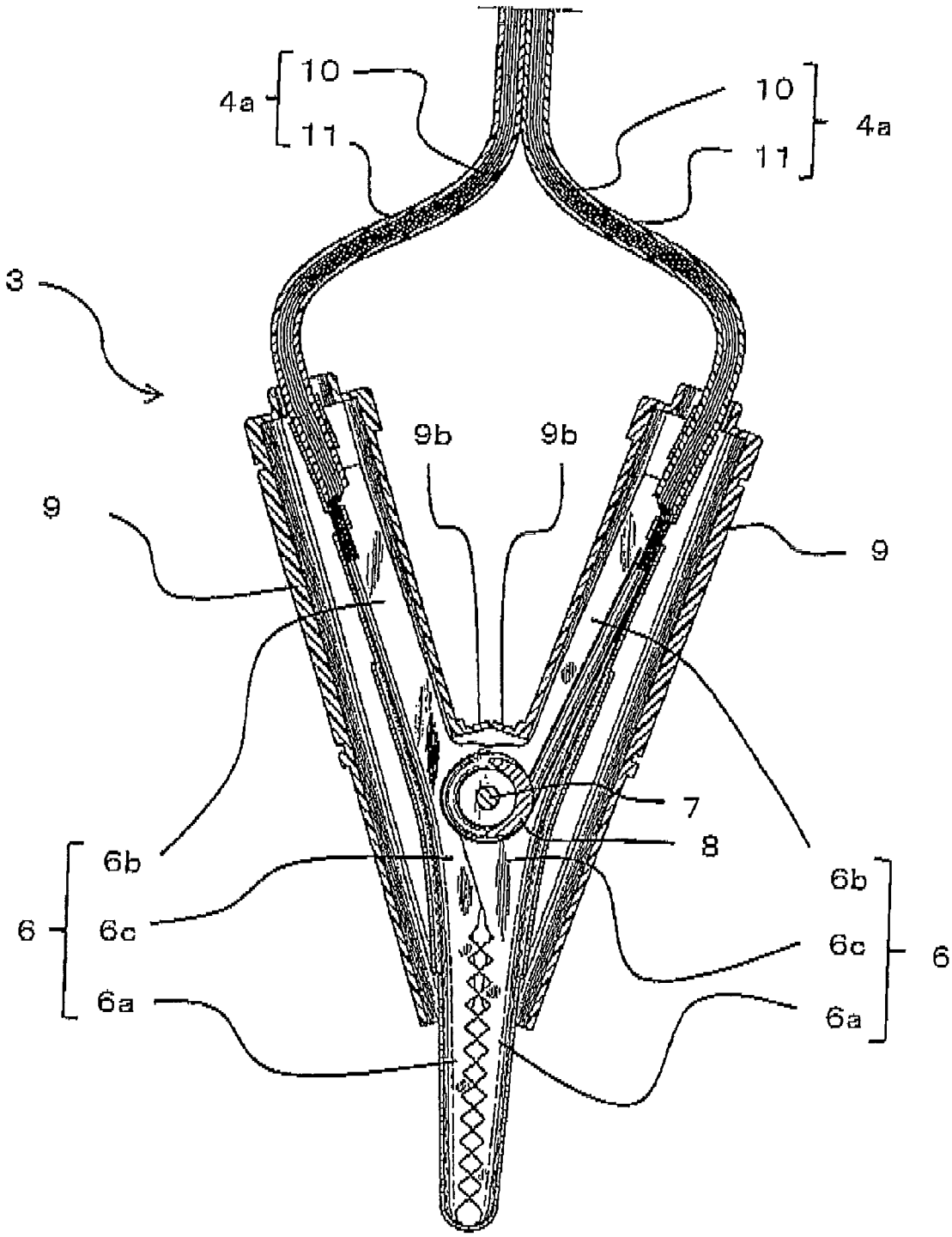
FIG. 8 is a sectional view of FIG. 2 taken along the line A-A.

When an auxiliary battery 2 of an automobile is completely discharged, for example, a booster cable 1 is used for supplying electricity from a battery of an assisting car to the auxiliary battery 2. As shown in FIG. 1, the booster cable 1 has a structure in which connecting clips 3 are attached to both ends of a cable main body 4, and the connecting clips 3 at the both ends are connected to an assisting terminal 5 of the automobile and to an electrode terminal of a battery of the assisting car.

As shown in FIGS. 2 to 8, the connecting clip 3 has a structure in which a pair of metal members 6 that have clamping sections 6*a* on the tip end part, gripping sections 6*b* on the base end part, and center sections 6*c* therebetween are pivotally joined with each other. The connecting clip 3 is configured so that the pair of clamping sections 6*a* open and close by gripping the gripping sections 6*b* and the clamping sections 6*a* clamp an assisting terminal 5 or an electrode terminal of a battery so as to be electrically connected.

The metal members 6 are formed by bending a flat metal element into a cross-sectional U shape by a bending method or a pressing method, and are arranged with a pair of open sides of the cross-sectional U shape being brought to face each other. In the pair of metal members 6, portions formed so as to protrude inward on the upper and lower surface sides of the center sections 6*c* are overlapped with each other, and the center sections 6*c* are joined via a pivoting shaft 7. A coil spring 8 is disposed around the pivoting shaft 7 so as to drive the metal members 6 in the closing direction of the clamping section.

The clamping sections 6*a*, the gripping sections 6*b* and the center sections 6*c* of the metal members 6 are formed so that the outer surfaces thereof continue, and the outer surfaces of the center sections 6 *c* are formed to be recessed curved surfaces. Thereby, the pair of clamping sections 6*a* are set to have the outer surfaces substantially in parallel with each other in the closed state and to have approximately same thickness up to the root portions. The clamping sections 6*a* are inserted into a limited space up to the root portions so as to clamp the assisting terminal 5 that is provided in the limited space. In addition, the clamping sections 6*a* are formed to be wide so as to stably clamp the flat assisting terminal 5 from the tip end thereof. Furthermore, the clamping sections 6*a* are formed with teeth in the inner edges thereof so that slip in clamping the assisting terminal 5, etc., is inhibited.

Outer surface sides of the gripping sections 6*b* and the center sections 6*c* are covered by an insulating cover 9 that is in a sleeve-tube shape made of an insulating resin. The insulating cover 9 covers the outer surface sides of the gripping sections 6*b* and the center sections 6*c* while exposing the clamping sections 6*a* so that the user does not receive electrical shocks when connecting to the assisting terminal 5 or the like.

In a portion covering the center sections 6*a* of the insulating cover 9, a total of four protrusions 9*a* are formed to be positioned on the right and left of the pivoting shaft 7. The protrusions 9*a* prevent the pivoting shaft 7 exposed from the insulating cover 9 from causing short-circuit by contacting with other metal or the like. In a portion covering a border part between the gripping sections 6*b* and the center sections 6*a* of the insulating cover 9, a total of two fins 9*b* are formed so as to protrude inward from right and left. The fins 9*b* prevent the center sections 6*c* exposed from the insulating cover 9 from causing short-circuit by contacting with other metal or the like.

The cable main body 4 has a structure in which, for example, two lines of conductive wires that include a copper-made core wire 10 covered by an insulating resin 11 are formed in parallel and integrally. The end portion of the cable main body 4 is branched and forked into each of the conductive wires to have the length in a range of about the same length of the metal members 6. Each of the branch sections 4*a* is inserted from the base end part into the insulating cover 9 to intrude the inside of each of the U-shaped metal members 6. The core wire 10 is exposed from the insulating resin 11 in the tip end portions of the branch sections 4*a*. The exposed portion of the core wire 10 is pressed and connected by a clasping piece that is formed by making a cut near the base end of the gripping section 6*b*, thereby the branched sections 4*a* are electrically connected to the gripping sections 6*b*.

Figure 9:
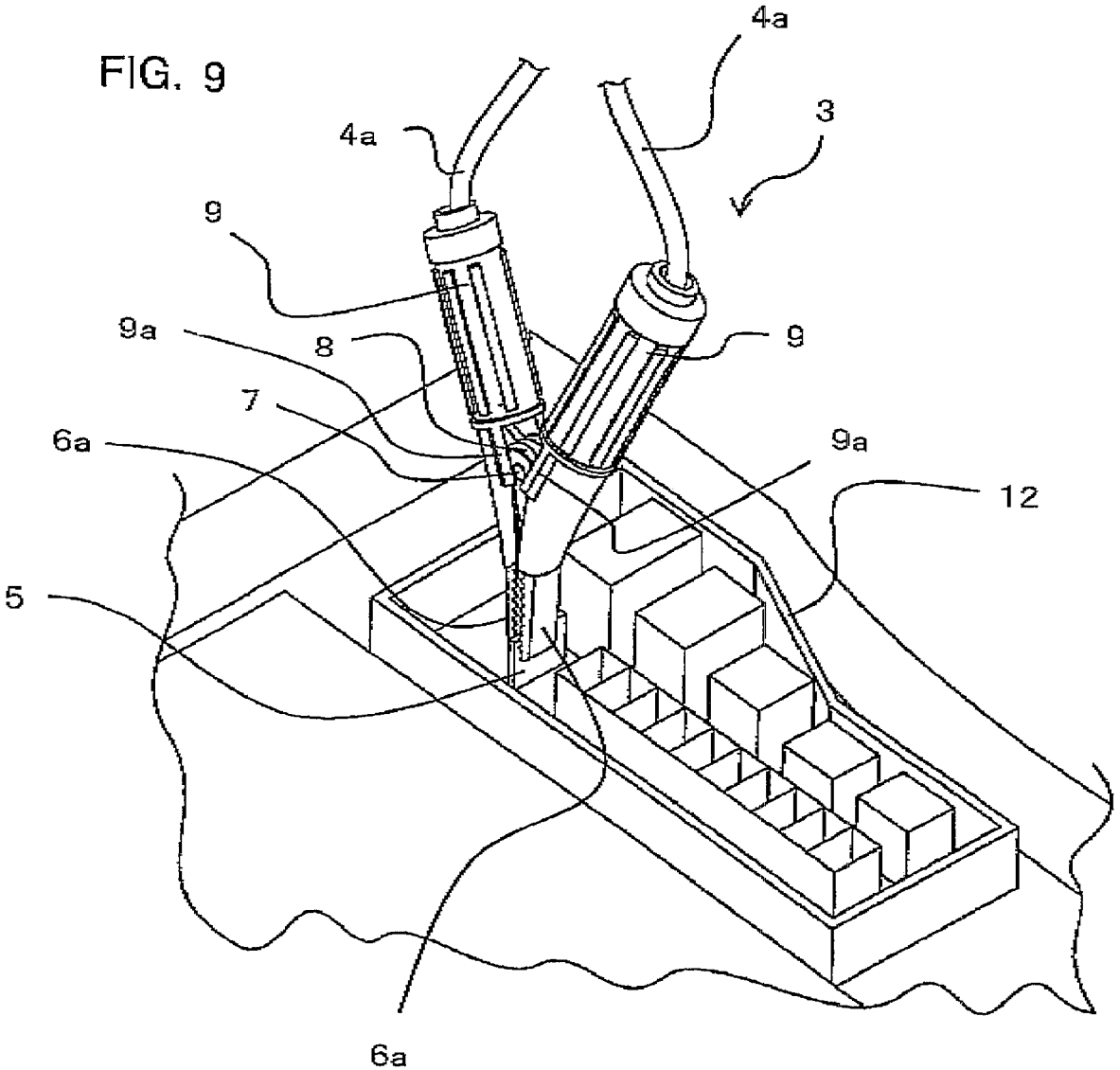
FIG. 9 is a perspective view of the connecting clip connected to an assisting terminal.
Figure 10:
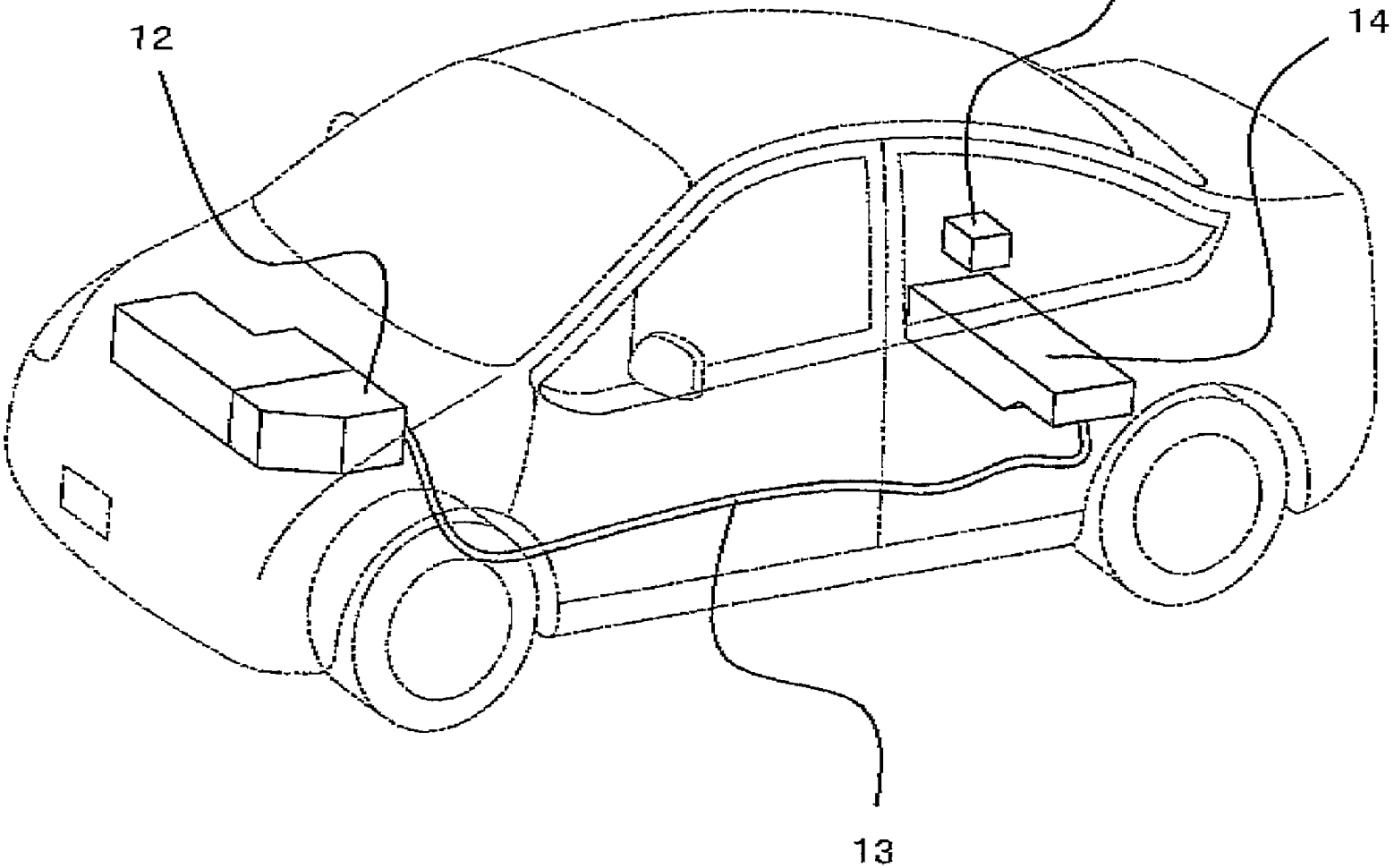
FIG. 10 is a perspective view showing an arrangement of a battery and a fuse box of an automobile.

As shown in FIG. 9, the assisting terminal 5, which is formed into flat, is protrudingly provided inside a fuse box 12 so as to be clamped from the tip end part thereof by the clamping sections 6*a* of the connecting clip 3. As shown in FIG. 10, the fuse box 12 is equipped in an engine room of an automobile and is electrically connected through a cable 13 to a hybrid battery 14 and the auxiliary battery 2 that are provided in a rear section of the automobile.

According to the structure above, since the wide clamping sections 6*a* of the booster cable 1 are capable of being inserted into a limited space of the fuse box 12, it is possible that the clamping sections 6*a* stably clamp the flat assisting terminal 5 that is protrudingly provided inside the fuse box 12 from the tip end part thereof. Thereby, the connecting clips 3 at both ends of the booster cable 1 are connected to the assisting terminal 5 and to an electrode terminal of a battery of an assisting car so that electricity can be supplied from the battery of the assisting car to the auxiliary battery 2.

Furthermore, since each of the branch sections 4*a* is connected to the both gripping sections 6*b*, grip ends of the gripping sections 6*b* are inhibited from projecting. Thereby, it is possible to prevent that the cable main body 4, etc., are hitched by the grip ends, thus it is possible to make connecting work of the booster cable 1 easier.

Furthermore, since each of the branch sections 4*a* is connected to the both gripping sections 6*b*, electricity flows through the both metal members 6 without passing through the pivoting shaft 7 or the coil spring 8. Thereby, it is possible to prevent heat generation by reducing electric resistance between the both clamping sections 6*a* contacting the assisting terminal 5, etc., and the cable main body 4 without grounding the both metal members 6 by a member such as brass. Furthermore, the current flowing through the coil spring 8 is able to be reduced to prevent the deterioration of the coil spring 8.

When an auxiliary battery of an automobile is completely discharged, the booster cable according to the present invention is connected to an assisting terminal provided in a fuse box in an engine room so as to be used for supplying electricity from a battery of an assisting car to the auxiliary battery.

What is claimed is:

1. A booster cable in which a connecting clip is attached to both ends of a cable main body, wherein the connecting clip is covered by an insulating cover, and so that a pair of clamping sections that are exposed from the insulating cover are inserted into a limited space to be capable of clamping a flat terminal connected to a battery side from a tip end part of the terminal, it is set such that the pair of clamping sections in their closed state are wider perpendicularly to the direction for the clamping sections to open and close than to the direction for the pair of clamping sections to open and close and outer surfaces of the pair of clamping sections in their opening/closing direction are substantially parallel in a closed state of the clamping sections, and wherein the clamping sections are formed with teeth in the upper and lower surfaces and the inner edges of the tip end thereof.

2. A booster cable in which a connecting clip is attached to both ends of a cable main body, wherein the connecting clip is covered by an insulating cover, and so that a pair of clamping sections that are exposed from the insulating cover are inserted into a fuse box equipped in an engine room of an automobile to be capable of clamping a flat assisting terminal that is protrudingly provided inside the fuse box and electrically connected to an auxiliary battery from a tip end part of the assisting terminal, it is set such that the pair of clamping sections in their closed state are wider perpendicularly to the direction for the clamping sections to open and close than to the direction for the pair of clamping sections to open and close and outer surfaces of the pair of clamping sections in their opening/closing direction are substantially parallel in a closed state of the clamping sections, and wherein the clamping sections are formed with teeth in the upper and lower surfaces and the inner edges of the tip end thereof.

* * * * *

UNITED STATES PATENT AND TRADEMARK OFFICE

CERTIFICATE OF CORRECTION

PATENT NO. : 8,210,869 B2
APPLICATION NO. : 12/504811
DATED : July 3, 2012
INVENTOR(S) : Yoshiaki Nakatsuka It is certified that error appears in the above-identified patent and that said Letters Patent is hereby corrected as shown below:

ON THE TITLE PAGE:

An item (75), Inventor, change "Yoshiaki Nakatsuka, Naka (JP)" to --Yoshiaki Nakatsuka, Nara (JP)--.

Signed and Sealed this
Eleventh Day of September, 2012

David J. Kappos

David J. Kappos
*Director of the United States Patent and Trademark Office*